US005779317A

United States Patent [19]

Neal

[11] Patent Number: 5,779,317

[45] Date of Patent: Jul. 14, 1998

[54] CHAIR WITH INTERCHANGEABLE CHAIR COMPONENTS

[75] Inventor: Bill G. Neal, Chuckey, Tenn.

[73] Assignee: MECO Corporation, Greeneville, Tenn.

[21] Appl. No.: 699,017

[22] Filed: Aug. 16, 1996

[51] Int. Cl.[6] ..... A47C 7/00

[52] U.S. Cl. ..... 297/440.2; 297/440.22; 297/452.21; 297/452.29

[58] Field of Search ..... 297/440.14, 452.38, 297/452.55, 452.57, 452.58, 452.22, 440.2, 440.22, 452.21, 452.23, 452.24, 452.29, 452.33; 403/381, 354, 364

[56] References Cited

U.S. PATENT DOCUMENTS

| | | | |
|---|---|---|---|
| Re. 29,522 | 1/1978 | Barecki | 297/445 |
| 275,823 | 4/1883 | Hale . | |
| 277,272 | 5/1883 | Hale . | |
| 575,300 | 1/1897 | Homer | 297/440.22 X |
| 1,355,669 | 10/1920 | Henry | 297/440.22 |
| 2,281,902 | 5/1942 | Witz | 155/196 |
| 2,302,969 | 11/1942 | McMahan | 155/194 |
| 2,306,878 | 12/1942 | Greitzer | 155/178 |
| 2,461,055 | 2/1949 | Greitzer | 155/194 |
| 2,668,584 | 2/1954 | Greitzer | 155/196 |
| 2,783,828 | 3/1957 | Weill | 155/184 |
| 2,829,707 | 4/1958 | Liebson | 155/191 |
| 2,960,152 | 11/1960 | Wendel | 155/191 |
| 3,054,156 | 9/1962 | Cohen | 24/73 |
| 3,245,715 | 4/1966 | Gits | 297/59 |
| 3,501,197 | 3/1970 | Barton | 297/452.58 X |
| 3,655,239 | 4/1972 | Agosti | 297/331 |
| 3,669,499 | 6/1972 | Semplonius et al. | 297/440.2 X |
| 3,751,107 | 8/1973 | Greitzer | 297/455 |
| 3,841,704 | 10/1974 | Platner et al. | 297/440.2 X |
| 3,948,557 | 4/1976 | Barecki | 297/283 |
| 3,989,300 | 11/1976 | Heumann | 297/440 |
| 4,043,591 | 8/1977 | Lehmann | 297/440.14 X |
| 4,045,080 | 8/1977 | Barecki et al. | 297/283 |
| 4,077,666 | 3/1978 | Heumann | 297/440.14 |
| 4,099,774 | 7/1978 | Sandham | 297/440.2 X |
| 4,365,840 | 12/1982 | Kehl et al. | 297/443 |
| 4,523,787 | 6/1985 | Robinson | 297/440 |
| 4,544,205 | 10/1985 | Molnar | 297/455 |
| 4,674,795 | 6/1987 | Nelson | 297/239 |
| 4,830,435 | 5/1989 | Nemschoff et al. | 297/440 |
| 5,184,871 | 2/1993 | LaPointe et al. | 297/444 |
| 5,253,923 | 10/1993 | Gootee | 297/440.21 |
| 5,382,080 | 1/1995 | Gamgerini et al. | 297/440.1 |

*Primary Examiner*—Milton Nelson, Jr.
*Attorney, Agent, or Firm*—Roberts & Brownell, LLC

[57] ABSTRACT

A mix and match chair having a plurality of legs and removable chair components such as seats, backrests, footrests, and armrests. The mix and match chair comprises a chair frame having a backrest portion and a seat portion. Attached to the backrest and seat portion is a backrest pan and a seat pan, respectively. The pans have holes and at least one raised locator area. The seat and backrest have arcuate shaped apertures and a cutout. The cutouts mate with the raised locator area of the pans. Thus, the locator areas provide a mechanism for precise placement of the chair component and for the firm attachment of the chair component to the chair frame. Extending through the arcuate shaped apertures and the holes are fasteners. Other chair components are provided with the same mechanism for attaching to the chair frame.

25 Claims, 6 Drawing Sheets

CHAIR WITH INTERCHANGEABLE CHAIR COMPONENTS

FIELD OF INVENTION

The present invention relates generally to a folding chair having removable chair components of varying designs that can be interchanged by the user. More particularly, the present invention relates to a chair which has decoratively upholstered removable seats, backrests, headrests, armrests, and footrests which easily and securely attach to a chair frame by the consumer without the need for costly re-upholstering.

BACKGROUND AND DESCRIPTION OF RELATED ART

Chair manufacturers typically manufacture and assemble chairs and their component parts at the factory. This usually includes manufacturing a colored chair frame and decoratively covered seats, backrests and other components. Thereafter, the manufacturer assembles the chair by selecting a specific decoratively designed component and attaching it to a particularly colored chair frame.

Keeping the above in mind, and the fact that an infinite number of combinations of chairs and fabrics is possible, the manufacturer is only capable of manufacturing a limited number of decorative chairs for the consumer due to design costs, and other appreciable manufacturing expenses. Because of these constraints consumer choice is limited to those particular chair design combinations that are manufactured and assembled at the factory. This, in turn, means that the chair manufacturer has a limited appeal to the public, and thus, is not capable of tapping the full potential of the consumer market. In other words, many consumers will purchase a second manufacturer's chair because a style produced by a first manufacturer does not meet their tastes.

Even if the manufacturer decided to manufacture hundreds of different combinations of chairs, the consumer may still desire yet a different combination. If this were the case, the manufacturer would have gone through great expense and time in manufacturing, shipping and attempting to sell the various chair styles.

Another concern of manufacturing several different chair designs is the manner in which the chairs are stored. In order to store several different chair designs, retail stores require a tremendous amount of storage space. Needless to say, the retailer would also need a vast amount of showroom space to display all of the chair design components. This would be both impractical and extremely costly to the manufacturer and retailer. In essence, these shortcomings would be passed to the consumer in higher prices for those chairs.

Unfortunately for the consumer there is no current manner of purchasing a chair frame separately from the constituent chair components, such as a padded seat, backrest, and the like. If this separate purchase were possible, a consumer would be able to choose a frame and thereafter a suitable chair component. The frames and padded chair components could comprise several different colors and designs, respectively. By doing this, the manufacturer can produce substantially more and differently designed chair components to the consumer. The consumer could then pick and choose the exact combination of chair frame and component desired. By utilizing this procedure the retail stores can also stock and display more chairs and chair components without undue costs of display and storage resulting in added costs to be passed on to the consumer.

Existing chairs do not provide a mechanism for the consumer to mix and match a chair frame and its components parts. For example, a chair seat will usually be constructed from molded press board or other support structure having a padded cushion and a decorative material attached to one side. The padded cushion is set over the molded press board and the decorative material is then permanently placed over the padding. Screws or other permanent means then secure the padded chair component to the chair surface (the seating surface). In many instances special tools and skills are required to properly accomplish this tasks.

Several inventors have attempted to devise methods for the construction of chairs. These methods, however, are complex such that a consumer without special tools and skills would not be able to assemble the chair frame to its component parts. Additionally, even if the consumer was able to assemble the chair there are no known manufacturers that separately sell chair frames and components to the consumer.

U.S. Pat. No. 5,382,080 to G. Gamberini et al. discloses a chair having a base and seating structure. The base and seating structure are assembled via a coupling device accomplished by a pin and screw assembly. The seating structure consists of a four part frame having a seat structure, back rest structure, and a pair of L-shaped connecting means. The back rest structure comprises a back rest and a U-shaped frame having two tubular side members.

Several inventors have also devised methods of attaching chair seats and back supports to tubular chair frames. Typically, these methods comprise a complicated method of manufacturing that would be too costly to produce. For example, U.S. Pat. Nos. 2,306,878, 2,461,055 and 2,668,584 to M. Greitzer all disclose a method of attaching a seat and back support to a chair frame using a complex arrangement of spring loaded channels. Variations of this theme disclose supports having flanges that fit securely against the chair frame and are attached by means of screws or hooks. Other variations include a connector insert bar that has a spring latch which is adapted to enter the ends of the chair frame.

Similar to the M. Greitzer disclosure are U.S. Pat. No. 2,281,902 to S. R. Witz and U.S. Pat. No. 5,253,923 to L. Gootee. The '902 patent to S. R. Witz discloses a chair frame having bent tubular members defined as back posts, seat supporting members, and a base frame. The back posts are flattened so that a back rest having rectangular apertures can communicate therein. The seat portion is attached to the seat supporting members by a screw assembly. The '923 patent to L. Gootee discloses an automotive type seat having a back rest and a seat. A pair of rigid coupling bars are secured to a seat base frame so that the back rest can be attached thereto.

Other means of fastening seats and chair supports to chair frames include clip or screw and flange mechanisms. For instance, U.S. Pat. No. 3,245,715 to J. C. Gits discloses a folding tube frame chair with a snap-on chair seat and backrest. Integrally molded to the chair seat and backrest are split sleeve clips which attach to the chair frame. The split sleeve clips further serve as locking devices for the folding legs. The problem with this device, however, is that the chair seat and back rest have a tendency to slip and, after several uses the clips lose their compressive properties.

Additionally, U.S. Pat. No. 3,054,156 to M. R. Cohen discloses a fastening clip. The clip secures a chair seat to a tubular frame. The clip is a spring clip formed from a stamped piece of metal. Variations of the clip mechanism includes U.S. Pat. No. 2,302,969 to R. F. McMahan wherein a chair structure comprising two vertical side frames joined by rungs. The seat of the chair is snapped into place across the rungs and a portion of a downwardly extending portions of an armrest.

Simple mechanism such as Velcro fastening means have also been used. These fastening means, however, are easily displaced from their preferred positions on the chair's surface. For example, the weight of the user, or simple adjustments in the user's sitting positions, easily dislodge the chair seat or back support. This is very uncomfortable to the user and, in fact, may be dangerous if the seat or back support completely disengages from the chair frame when the user is seated. Examples of Velcro attaching systems include U.S. Pat. No. 4,365,840 to N. J. Kehl et al. and U.S. Pat. No. 4,674,795 to J. M. Nelson. The '840 patent to N. J. Kehl et al. discloses a Velcro® type fastening between the seat cushion and the back cushion with a clip mechanism to hold the bottom of the back to the frame while a bracket secures the top of the back to the frame. The '795 to J. M. Nelson discloses a stackable tubular chair frame, wherein a chair seat and back consists of a flexible seating and backrest material is held in place by VELCRO. This seat does not give any support to the user. Other simple means of attaching a seat and back rest to a chair frame includes U.S. Pat. No. 275,823 to H. S. Hale which discloses a chair having an upper portion consisting of a tie rod and the lower portion consists of a crossbar. Attached to the tie rod is a back cushion frame which communicates with the tie rod by a semicircular member that sits over the tie rod.

U.S. Pat. No. 2,783,828 to B. R. Weill also discloses a simple means of attaching a chair component to a chair frame. A seat and back rest cushion having front and rear face panels are connected to the chair by a flat elongated flexible strip which is supported by the rear face panel of each cushion.

Various of other attachment means have also been devised. For example, U.S. Pat. No. 2,829,707 to S. Liebson, U.S. Pat. No. 3,989,300 to J. M. Heumann, U.S. Pat. No. 4,523,787 to W. R. Robinson disclose several methods of attaching seats and backrests to living room furniture, such as sofas and love seats. U.S. Pat. No. 2,960,152 to G. M. Wendel discloses "blocked furniture", whereby a seat and back cushion element are composed of multiple interchangeable blocks. Additionally, U.S. Pat. No. 4,544,205 to J. Molnar shows a self-locking cushion assembly which is attached and removed from a seat shell. Lastly, U.S. Pat. No. 4,830,435 to L. M. Nemschof et al. describes a seating unit having a pair of supports spaced apart and connected by cross beams to a seat subassembly.

All of the above references use fastening mechanisms and other complicated assemblies that do not necessarily allow for easy manufacture, assembly, and disassembly by a consumer. What is needed to meet the needs of consumers for "mix and match" chairs is a system that is easy to assemble and disassemble. This chair would include several removable upholstered chair components, such as seats, backrests, armrests, etc., of varying designs that can be interchanged by the user. This chair would be easy to assemble and disassemble without the need for special tools or skills, and would also be inexpensive to manufacture. Additionally, the chair would be constructed so that all constituent components are securely fixed to one another utilizing a simple design fashioned for easy assembly and disassembly. In order to accomplish the above, the removable chair components would have a fastening assembly which cooperates with apertures on a chair frame. Further, the chair components would have a cutout that would mate with a raised locator area on the chair frame.

SUMMARY OF THE INVENTION

It is therefore an object of the present invention to provide a mix and match chair that is easily assembled and disassembled by a consumer in desired combinations.

It is an object of the present invention to provide a mix and match chair that utilizes removable decorative chair components such as chair seats, backrests, armrests, etc and various chair frames.

It is a further object of the present invention to provide a mix and match chair that has a fastening mechanism that firmly secures the removable decorative chair components to the chair frame.

These and other objects and advantages of the present invention will be apparent to those of ordinary skill in the art upon inspection of the detailed description, drawings, and appended claims.

The mix and match chair ("the present invention") allows for easy assembly and disassembly by consumers with no special equipment or skills. The present invention is also easily manufactured and eliminates the need for full assembly by the manufacturer since the chair is to be shipped without any padded upholstered chair components. In some instances, the manufacturer, however, may ship the chair in an assembled form. Thus, the present invention has the versatility of being assembled by the consumer, or in the alternative, at the factory by the manufacturer. The present invention also allows the manufacturer to produce a wider variety of chairs that would appeal to the consumer.

The present invention comprises a chair frame and attachable "chair components," such as seats and backrests of varying designs. The chair frame comprises tubular members forming a plurality of legs, a back portion, and a seat portion, and other seating surfaces, such as armrests, footrests, and headrests (collectively referred to as "seating surfaces"). The back portion is substantially c-shaped and accommodates a backrest pan having a plurality of holes and a raised locator area. The seat portion accommodates a seat pan having a plurality of holes and a raised locator area, as well. Other chair surfaces, such as, armrests, footrests, and headrests also have accompanying chair pans. The back and seat pan, as well as other pans, typically comprise a unitary piece of formed sheet metal.

The chair components, that is, the padded seating elements that attach to the chair frame at various locations, have an upper side and a lower side. The upper side of the chair components are padded and upholstered. The lower side of the chair components rests on the chair pan, backrest pan or other seating surface. The lower side of the chair component is typically a form of pressboard and provides support for the padding. For instance, a seat (i.e. a chair component) will rest on a seat pan (i.e. a seating surface) or an armrest would rest on an armrest pan.

The chair components have a substantially arcuate shaped aperture wherein downward extending attachment means having a head and a body extend therethrough. These attachment means can be nut and bolt assemblies, Christmas tree fasteners, screws, snaps, clamps, clips or other such equivalents that could be used to secure one surface to another.

The chair components also include a cutout. This cutout serves as a storage area for the fastening means during shipment of the attachable chair components. Thus, the fastening means no longer need to be taped (or fastened by other means) to the chair component's surface. This means of shipment prevents the chair's surface or other chair components from being scratched, chipped or otherwise damaged during shipping. The cutout also conforms to the shape of the raised locator area of the chair pan.

In order to attach the chair components to the seating surfaces, the head of the fastening means is passed through the arcuate shaped aperture of the chair components and the body of the fastening means is passed through the hole of the corresponding seating surface. Additionally, the cutout of the chair component is mated to the corresponding raised locator area of the chair pan. For example, a seat is placed on a seat pan and a fastening means is passed through the arcuate shaped aperture of the seat and through the hole of the seat pan. The cutout of the chair component is then mated to the corresponding raised locator area of the seat pan. The height of the raised locator area is equal to the thickness of the underlying support of the chair component.

Thus, utilizing the mix and match chair of the present invention, the consumer can purchase a chair frame in a variety of colors, yet have the freedom to interchange several upholstered chair components of varying designs at an inexpensive price. The present invention also allows the consumer to change any chair component without the need of any special equipment or know-how.

DETAILED DESCRIPTION OF THE INVENTION

The present invention is directed towards a chair with attachable upholstered decorative chair components, such as seats and backrests which are easy to attach and remove from a chair frame. The dimensions of the present invention, including length, width, shape, and other variables and quantities specified herein may vary with the type of chair contemplated. Therefore, numbers and dimensions specified herein are not to be construed as limitations on the scope of the present invention. They are meant to be merely illustrative of one particular application.

The present invention is a chair that is designed to have attachable decorative seats, backrests and other chair components, such as armrests, headrests, and footrests (hereinafter collectively known as chair components) attached to the respective seating surface. In addition, the present invention is capable of being easily assembled and disassembled by the consumer without the need of any special equipment or skill.

The use of attachable decorative chair components allows the manufacturer to produce a wider variety of chairs to meet the public's needs. This is accomplished by separately producing several chair frames and component parts having different colors and designs, respectively.

By producing the various chair frames and component parts separately, the retailer is capable of showcasing the chairs in a relatively small display area. This is accomplished by having several colored chair frames displayed on the display floor area with the accompanying component parts displayed on a wall unit, a free standing display unit, or other display structure. Alternatively, the chair components can be neatly and compactly stacked on the floor. This saves space, which, in turn, cuts costs for the retailers and the consumers. The following applications are a sample of uses that are envisioned when utilizing the various decorative chair components:

(i) formal dining chair;

(ii) outside leisure chair; and (iii) work chair;

Other embodiments will be obvious to those skilled in the art.

The present invention is designed from any material that is suitable for this purpose and which provides strength, stability, and support to the chair. In the present invention it is preferred that a steel frame of various colors and various decorative chair components be used. The shape of the present invention will vary in accordance with its numerous applications as previously illustrated.

Figure 1:
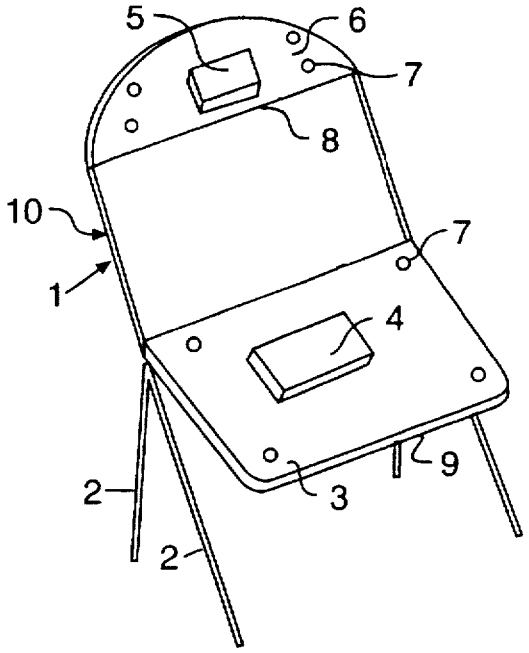
FIG. 1 shows a perspective view of a chair frame.

FIG. 1 shows a perspective view of a chair frame, generally designated 1. The chair frame 1 comprises tubular members 10 forming a plurality of legs 2, a back portion 8, and a seat portion 9 both defined as "seating surfaces." The back portion 8 is substantially c-shaped and accommodates a backrest pan 6 having a plurality of holes 7 and at least one raised locator area 5. The backrest pan 6 is spot welded to the tubular members 10 of the chair frame 1. However, other attachment means, such as clamps, dowels, pins, etc. are also envisioned. The raised locator area 5 is preferably formed by stamp pressing the backrest pan 6. The raised locator area may also be formed from a plate that is spot welded, or fastened in other conventional means, to the backrest pan 6. The raised locator area 5 acts as a guide for the precise and accurate placement of the chair component to the chair frame and as an attachment means for firmly attaching the chair pan to the chair component.

The seat portion accommodates a seat pan 3 having a plurality of holes 7 and a raised locator area 4. The seat pan 3 is spot welded to the tubular members 10 of the chair frame 1; however, other attachment means, such as clamps, dowels, pins, etc. are also envisioned. The raised locator area 4 is preferably formed by stamp pressing the seat pan 3. The raised locator area may also be formed from a plate that is spot welded, or fastened in other conventional means, to the seat pan 3. This raised locator area 4 also acts as a guide for the precise and accurate placement of the chair component to the chair frame and as an attachment means for firmly attaching the chair component to the chair frame.

Other chair components, such as armrests, footrests, and headrests are also envisioned having the same properties. For example, an armrest pan would have a plurality of holes and a raised locator area. The pan would be fixed to the chair frame by a spot weld or other conventional means.

Figure 2:
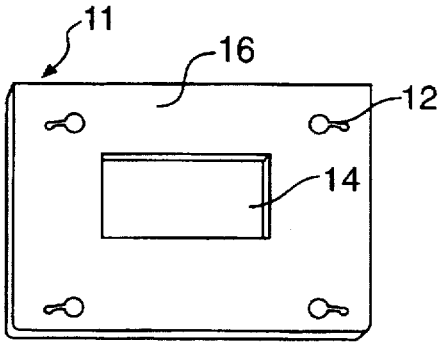
FIG. 2 shows a top side of an interchangeable chair seat.
Figure 3:
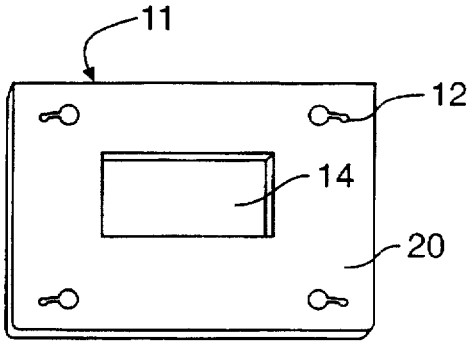
FIG. 3 shows a bottom side of an interchangeable chair seat.

FIGS. 2 and 3 show a top and bottom side of an attachable chair seat 11, respectively. The top side 16 of the seat 11 is padded and upholstered as further described below. The seat 11 has a plurality of fastening apertures 12, which are substantially arcuate shaped apertures, located generally at the corners. Extending through the arcuate shaped apertures 12 are downward extending attachment means having a head and a body. These attachment means can be nut and bolt assemblies, Christmas tree fasteners, screws, clips, snaps, clamps or other such equivalents that could be used to secure one surface to another. These fastening means are designed to be installed at the factory or by the consumer during assembly. The bottom side 20 of the seat 11 rests on the seat pan 3 of the chair frame 1 (refer to FIG. 3*a*).

The seat 11 also comprises a cutout 14. This cutout 14 serves as a storage area for the fastening means during shipment of the attachable chair components. This prevents the chair's surface or other chair components from being scratched, chipped or otherwise damaged during shipping.

The cutout 14 also conforms to the shape of the raised locator area 4 of the chair pan 3 in that the cutout 14 aligns with the raised locator area 4 of the seat pan 3. The cutout 14 can be any shape and placed at any position on the seat 11. The only limitation as to the shape and placement of the cutout 14 is that it correspond to the raised locator area 4. In other words, the cutout 14 and the raised locator area 4 must be the same shape and placed in the same position relative to one another.

Figure 3A:
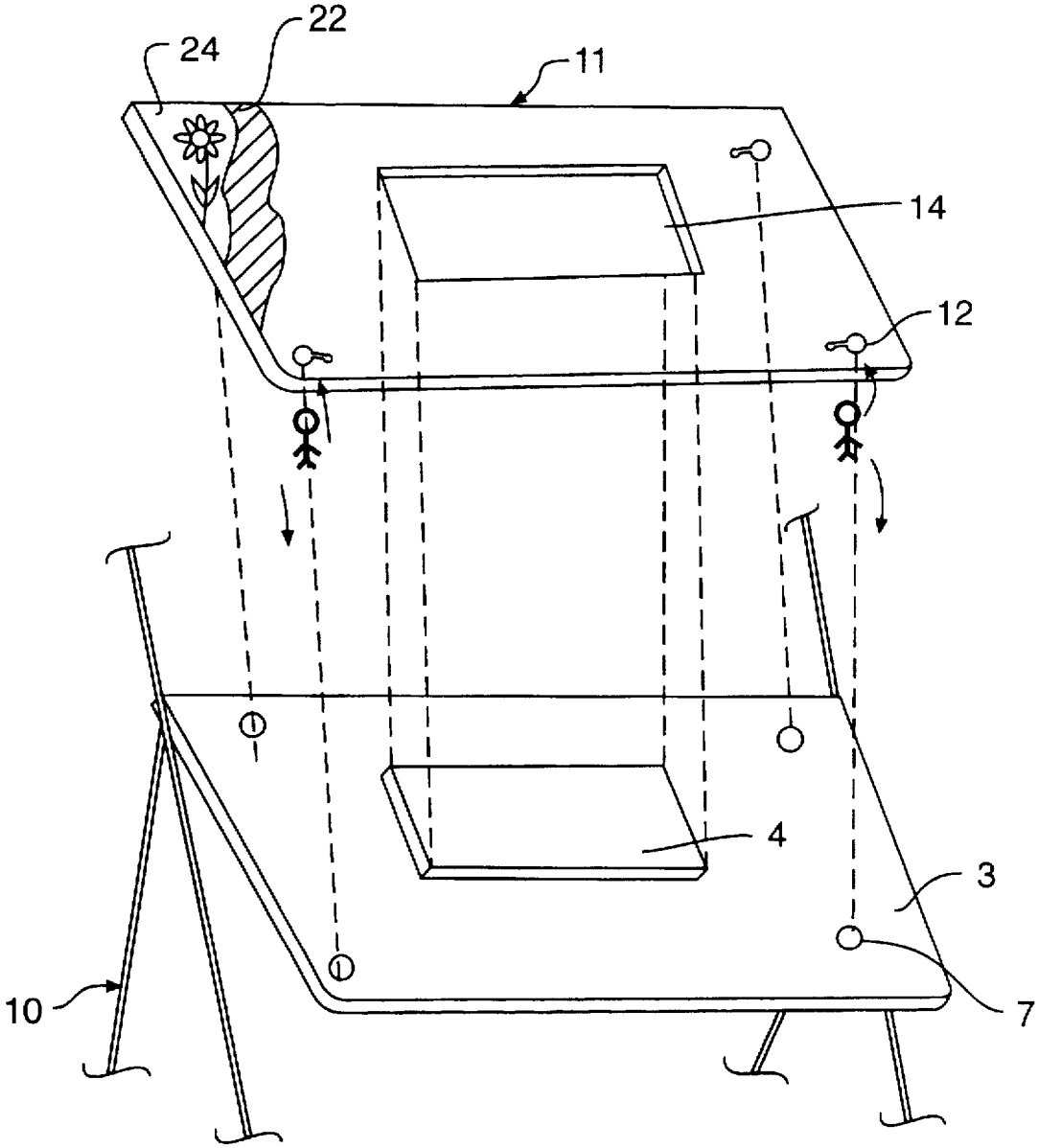
FIG. 3*a* shows the placement of a seat (chair component) on the seat pan (a seating surface).

FIG. 3*a* shows the placement of the seat 11 on the seat pan 3. The seat 11 is firmly attached to the seat pan 3 by the use of the fastening means in conjunction with the union of the cutout 14 and raised locator area 4. In order to attach the seat 11 to the seat pan 3 the head of the fastening means is extended through the arcuate shaped apertures 12 of the seat 11 and thereafter the body of the fastening means is passed through the holes 7 of the corresponding seat pan 3. Additionally, the cutout 14 of the seat 11 is aligned and mated to the corresponding raised locator area 4 of the seat pan 3. The height of the raised locator area 4 is substantially equal to the thickness of the underlying support board of the seat 11, thus making the seat uncomfortable to sit on without any perceived protrusions from the raised locator area 5.

Figure 4:
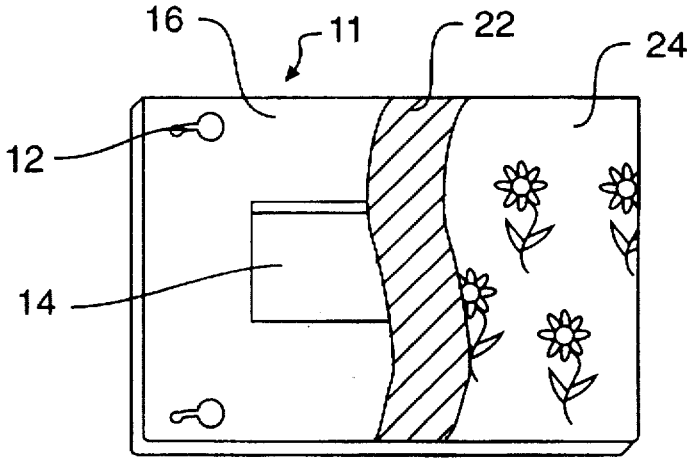
FIG. 4 shows the top side of an interchangeable chair seat with padding and an upholstered design.

FIG. 4 shows the top side 16 of the seat 11 with a padding and an upholstered design. The padding 22 is placed over the top side 16 of the seat 11 and, thus, covers the cutout 14. The upholstered covering 24 is placed over the padding 22. The padding 22 and upholstered covering 24 are attached to the seat 11 in a conventional manner. The upholstered covering 24 includes various designs and is not limited to that shown in FIG. 4.

Figure 5:
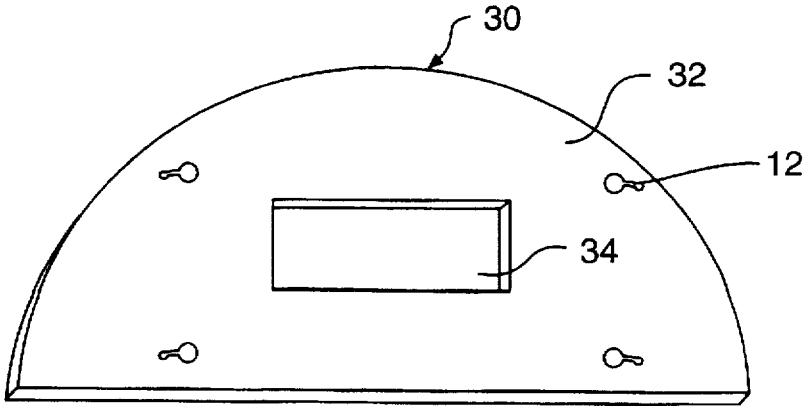
FIG. 5 shows the side front of an interchangeable backrest.
Figure 6:
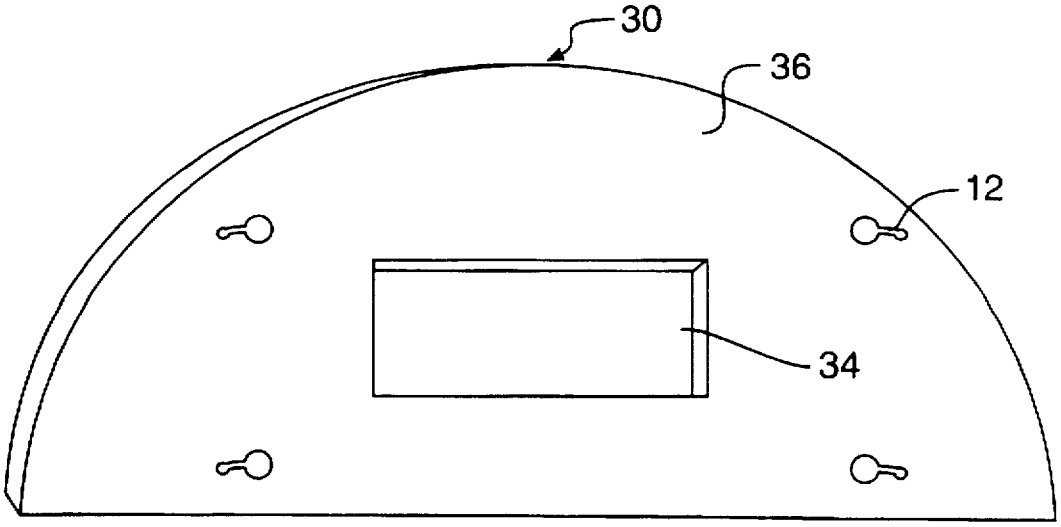
FIG. 6 shows the rear side of an interchangeable backrest.

FIGS. 5 and 6 show the front and rear side of an attachable backrest 30, respectively. The front side 32 of the backrest 30 is padded and upholstered as further described below. The rear side 36 of the backrest 30 rests on the backrest pan 6 of the chair frame 1. The backrest 30 has a plurality of fastening apertures 12, defined as substantially arcuate shaped apertures, located generally at the corners. Extending through the arcuate shaped apertures 12 are downward extending attachments. These attachment means can be nut and bolt assemblies, Christmas tree fasteners screw, snaps, clamps, clips or other such equivalents that could be used to secure one surface to another. These fastening means are further designed to be inserted at the factory or by the consumer during assembly.

The backrest 30 also comprises a cutout 34. This cutout 34 also serves as a storage area for the fastening means during shipment of the removable chair components. This prevents the chair's surface from being scratched, chipped or otherwise damaged during shipping.

The cutout 34 also conforms to the shape of the raised locator area 5 of the backrest pan 6. The cutout 34 can be any shape and placed at any position on the backrest 30. The only limitation as to the shape and placement of the cutout 34 is that it correspond to the raised locator area 5. In other words, the cutout 34 and the raised locator area 5 must be the same shape and placed in the same position relative to one another.

Figure 6A:
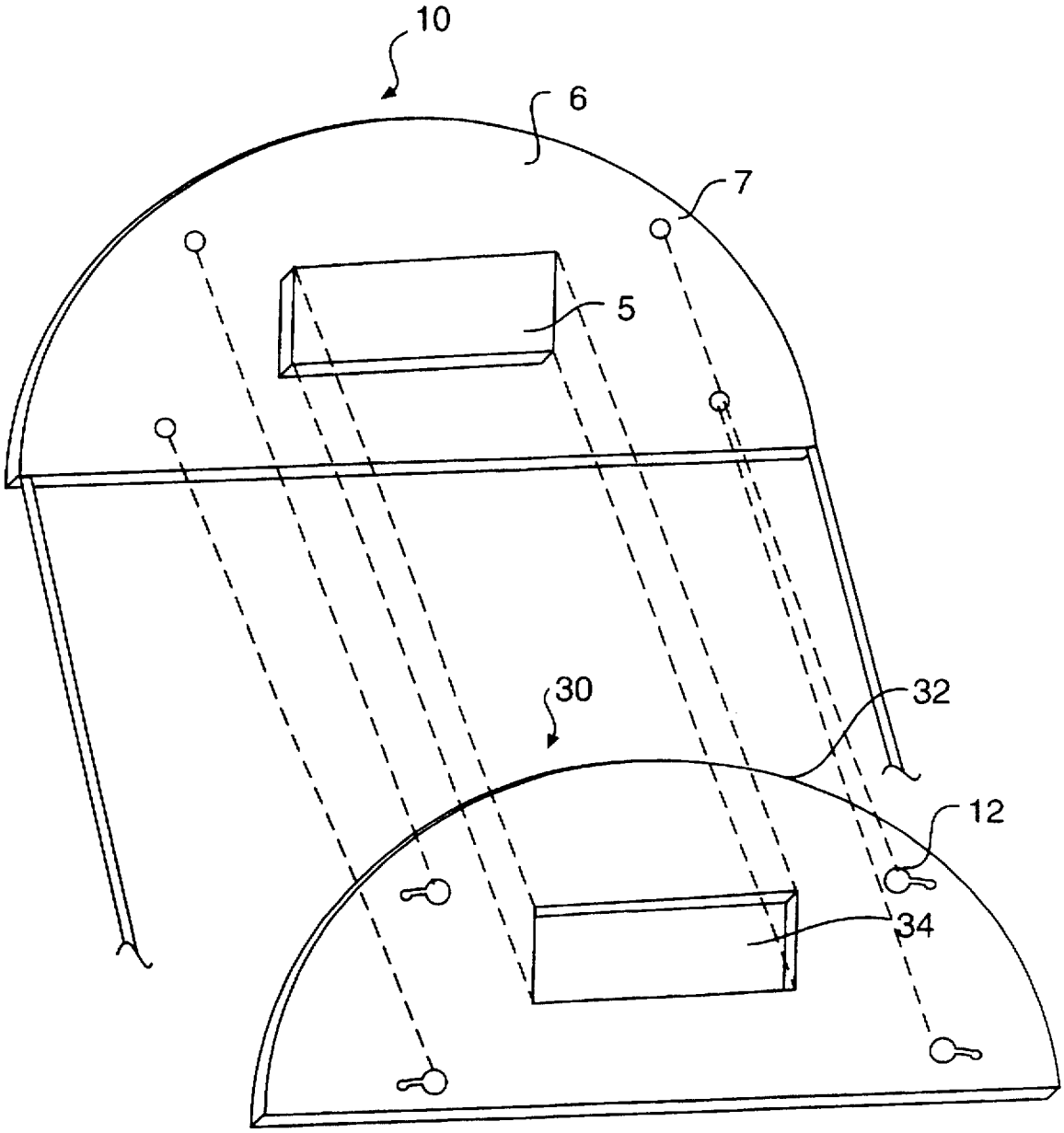
FIG. 6*a* shows the placement of the backrest (chair component) on the backrest pan (a seating surface).

FIG. 6*a* shows the placement of the backrest 30 on the backrest pan 6. The backrest 30 is firmly attached to the backrest pan 6 by the use of the fastening means in conjunction with the union of the cutout 14 and raised locator area 5. In order to attach the backrest 30 to the backrest pan 6 the head of the fastening means is extended through the arcuate shaped aperture 12 of the backrest 30 and thereafter the body of the fastening means is passed through the hole 7 of the corresponding backrest pan 6 by placing the backrest 30 on the backrest pan 6 with the fastening means extending downward. Additionally, the cutout 14 of the backrest 30 is aligned and mated to the corresponding raised locator area 5 of the backrest pan 6. The height of the raised locator area 5 is substantially equal to the thickness of the underlying support board of the backrest 30, thus making the seat uncomfortable to sit on without any perceived protrusions from the raised locator area 5.

Figure 7:
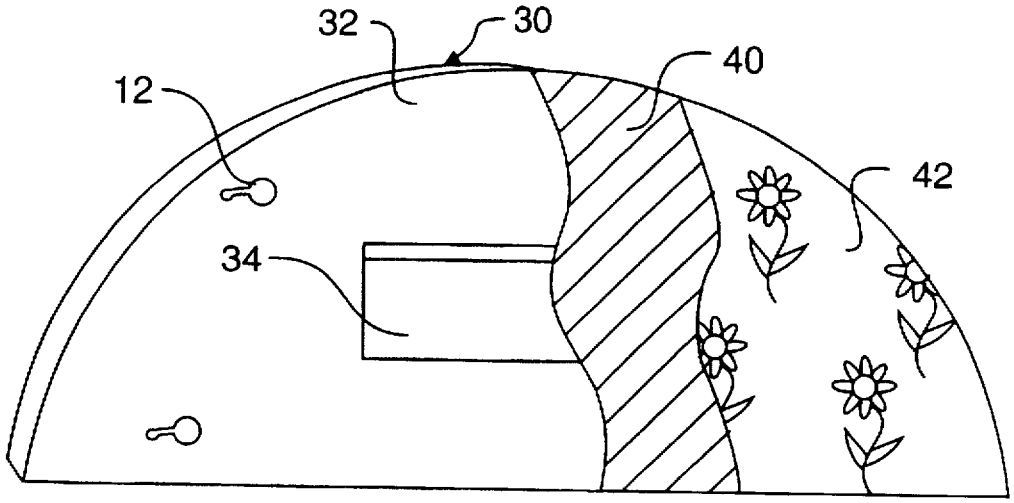
FIG. 7 shows the front side of an interchangeable backrest with padding and an upholstered design.

FIG. 7 shows the top side 32 of the backrest 30 with a padding and an upholstered design. The padding 40 is placed over the top side 32 of the backrest 30 and, thus, covers the cutout 14. The upholstered covering 42 is placed over the padding 40. The padding 40 and upholstered covering 42 are attached to the backrest 30 in a conventional manner. The upholstered covering 42 includes various designs and is not limited to that shown in FIG. 7.

Figure 8:
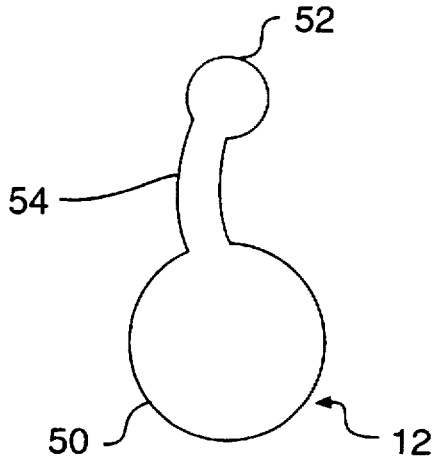
FIG. 8 shows an exploded view of the arcuate shaped aperture of the seat and backrest.

FIG. 8 shows an exploded view of the arcuate shaped aperture 12 located on the seat 11, backrest 30, or other chair component. In the preferred embodiment four arcuate shaped apertures 12 are placed on the seat 11, backrest 30, or other chair component. The arcuate shaped apertures 12 comprise a first end 50, a second end 52, and an arced center portion 54. The first end 50 is a substantially circular shaped portion having a certain diameter "x". The second end 52 is also a substantially circular shaped portion; however the diameter of the second end 52 is smaller than the diameter of the first end, e.g. "x-y," where "y" is some integer less than "x". In other words, the first end of the arcuate shaped fastening aperture is at least as large as the diameter of the head of the fastener and the second end is smaller than the diameter of the head of the fastener.

Connecting the first end 50 to the second end 52 is the arced center portion 54. In the preferred embodiment the first end 50 and the second end 52 are aligned so that a centerline can pass through the center point of both ends simultaneously. Additionally, it is preferred that the second end 52 be placed nearest the corners of the seat 11, backrest 30, or other chair component. Of course it is obvious to those skilled in the art that the arcuate shaped apertures 12 can be placed at any location or any orientation on the seat 11, backrest 30, or other chair component.

Alternate embodiments of the present invention also contemplate the use of other attachable chair components, in addition to the seat 11 and backrest 30. These additional chair components include, amongst others, armrests footrests, and headrests. To illustrate this point, an armrest can be attached to an armrest pan, e.g. seating surface, by the use of fastening means. The armrest pan would have a plurality of holes and a raised locator area. The armrest would have a cutout and an arcuate aperture. The armrest would be covered with padding and a decorative covering.

In order to firmly attach the seat 11 or backrest 30 to the seat pan 3 or backrest pan 6, respectively, downward extending attachments means are used. In the preferred embodiment Christmas tree fasteners are utilized. As an example, to attach the seat 11 to the seat pan 3 the installer ("the consumer") retrieves the fastening means from the cutout 14. The consumer then places the head of the fastener through the first end 50 of the arcuate shaped aperture 12. After placing the fastening means in the first end 50 of the arcuate shaped apertures 12, the consumer slides the fastening means across the arced center portion 54 until it "locks" into the second end 52 of the arcuate shaped apertures 12. The arced center portion 54 acts as a locking mechanism so that the fastening means does not slip. Thereafter, the consumer places the seat 11 on the seat pan 3 while the body of the fastening means extends downward. At this time, the consumer aligns the cutout 14 with the raised locator area 4 and the downward extending body of the fastening means with the holes 7 located on the seat pan 3. The consumer then presses the entire assembly together so that the body of the fastening means extends through the holes 7 located on the seat pan 3 and the cutout 14 slips over the raised locator area 4. At this point the assembly is complete and the seat 11 is securely fixed to the seat pan 3. The same procedure is used for attaching the backrest 30 to the backrest pan 6 and other chair components as described above, to the chair frame.

Figure 9:
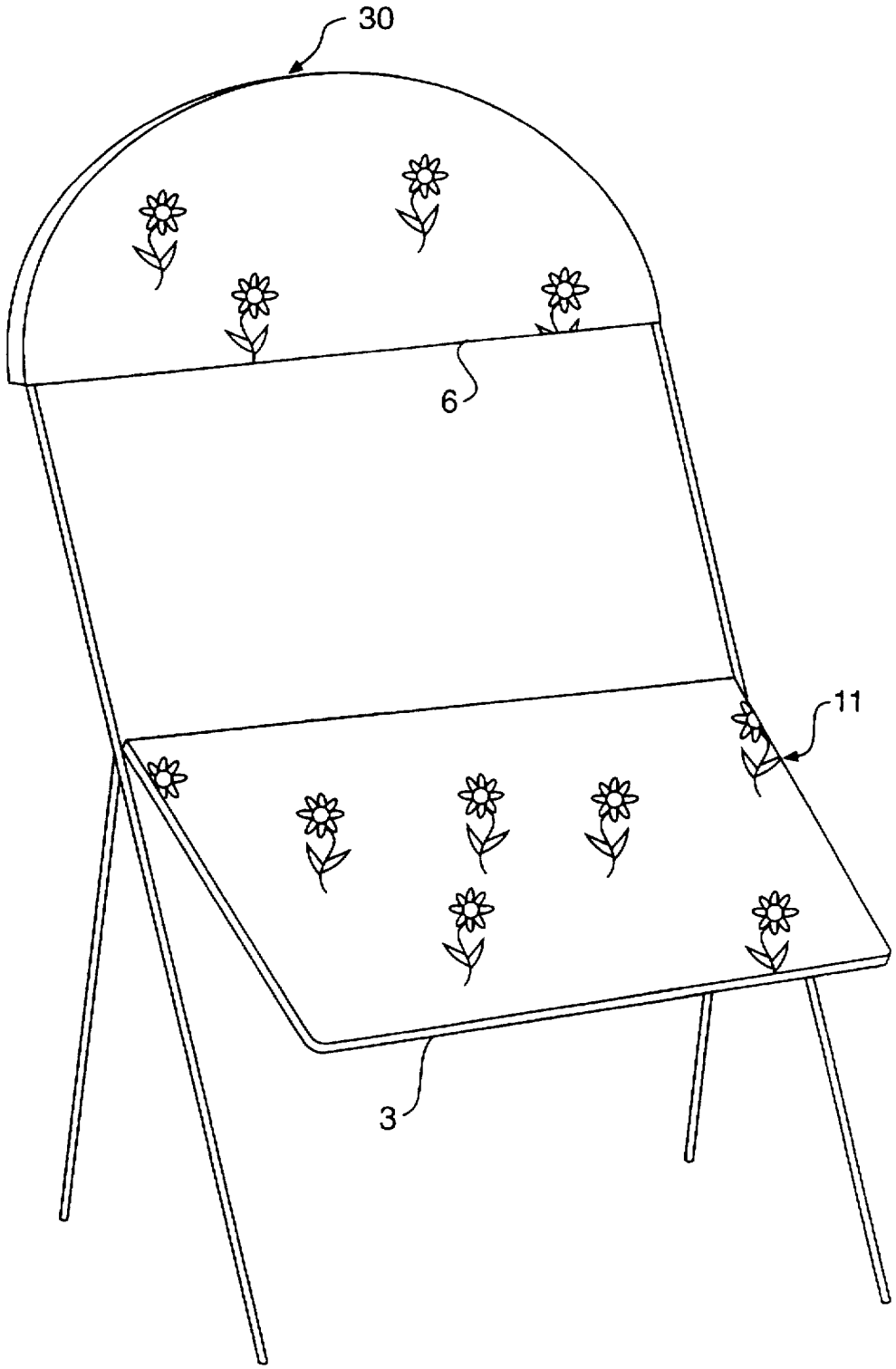
FIG. 9 shows a fully assembled chair having a seat and a backrest.

FIG. 9 shows a fully assembled chair having a seat 11 and a backrest 30. The seat is resting on the seat pan 3 and the backrest is resting on the backrest pan 4. The seat and backrest are attached by the fastening means and the cutouts and raised locator area as described above.

An alternate embodiment of the present invention comprises seating surfaces without any raised areas or cutouts. In this embodiment the arcuate shaped apertures are still present. Alternatively, the present invention comprises seating surfaces with raised areas but without arcuate shaped apertures present. Another alternative embodiment comprises multiple cutouts that cooperate with multiple raised areas on the seating surface.

Preferred and alternate embodiments of the present invention have now been described in detail. It is to be noted, however, that this description of these specific embodiments is merely illustrative of the principles underlying the inventive concept. It is therefore contemplated that various modifications of the disclosed embodiments will, without departing from the spirit and scope of the invention, be apparent to persons skilled in the art. For instance, it is obvious to one skilled in the art of the present invention that alternate embodiments of the present chair can include different shaped cutouts and apertures.

We claim:

1. A chair comprising:

(a) attachable chair components having a plurality of fastening apertures, each aperture having a first and second end and each attachable chair component having at least one cutout;

(b) seating surfaces having a plurality of holes and at least one raised locator area and wherein the at least one raised locator area fits into the at least one cutout;

(c) fasteners, the fasteners having heads and the heads having a diameter, the fasteners cooperating with the plurality of fastening apertures and the plurality of holes to attach the chair components to the seating surfaces.

2. A chair comprising:

(a) seating surfaces having a plurality of holes;

(b) attachable chair components having a plurality of fastening apertures each having a first end, a second end, and an arcuate section between the first end and the second end and at least one cutout; and (c) fasteners, the fasteners having heads and wherein the heads have a diameter, the fasteners cooperating with the plurality of fastening apertures and the plurality of holes to attach the chair components to the seating surfaces.

3. A chair comprising:

(a) attachable chair components having a plurality of fastening apertures and at least one cutout, wherein the plurality of fastening apertures each has a first end, a second end, and an arcuate section between the first end and second end;

(b) seating surfaces having a plurality of holes and at least one raised locator area and wherein the at least one raised locator area fits into the at least one cutout;

(c) fasteners, the fasteners having heads and the heads each having a diameter, the fasteners cooperating with the plurality of fastening apertures and the plurality of holes to attach the chair components to the seating surfaces.

4. A chair comprising:

(a) attachable chair components having at least one cutout and a plurality of fastening apertures, the fastening apertures comprising a first end, a second end, and arcuate section between the first end and the second end, the first end comprising a substantially circular shaped portion and the second end comprising a substantially circular shaped portion, wherein the first end of the arcuate shaped fastening apertures is at least as large as the heads of the fasteners and the second end is smaller than the diameter of the heads of the fasteners, the fasteners cooperating with the plurality of fastening apertures and the plurality of holes to attach the chair components to the seating surfaces;

(b) seating surfaces having a plurality of holes and at least one raised locator area and wherein the at least one raised locator area fits into the at least one cutout;

(c) fasteners, the fasteners having heads, wherein the heads each have a diameter.

5. A chair as in any of the preceding claims, in which the fasteners are taken from the group consisting of nuts and bolts, clamps, clips, Christmas tree fasteners, screws, and snaps.

6. A chair as in one of claims 1–4, in which the seating surfaces are taken from the group consisting of a seat pan, a backrest pan, an armrest pan, a headrest pan, and footrest pan.

7. A chair as in one of claims 1–4, in which the chair components are taken from the group consisting of a seat, a backrest, an armrest, a headrest, and footrests.

8. The chair according to claim 1, in which the plurality of fastening apertures each further comprise an arcuate section between the first and second end.

9. The chair according to claim 8 wherein the attachable chair components comprise padding and a decorative covering on a rigid support board.

10. The chair according to claim 8 wherein the first end comprises a substantially circular shaped portion and the second end comprises a substantially circular shaped portion having a smaller diameter than the first end, wherein the diameter of the first end is at least as large as the diameter of the head of the fastener and the diameter of the second end is smaller than the diameter of the head of the fastener.

11. The chair according to claim 10 wherein the attachable chair components comprise padding and a decorative covering on a rigid support board.

12. The chair according to claim 10 wherein the chair components are taken from the group consisting of a seat, a backrest, an armrest, a headrest, and a footrest.

13. The chair according to claim 12 wherein the attachable chair components comprise padding and a decorative covering on a rigid support board.

14. The chair according to claim 10 wherein the seating surfaces are taken from the group consisting of a seat pan, a backrest pan, an armrest pan, a headrest pan, and a footrest pan.

15. The chair according to claim 14 wherein the attachable chair components comprise padding and a decorative covering on a rigid support board.

16. A chair as in claim 2, in which the seating surfaces comprise at least one raised locator area.

17. The chair according to claim 16 wherein the attachable chair components comprise padding and a decorative covering on a rigid support board.

18. The chair according to claim 3 wherein the first end comprises a substantially circular shaped portion and the second end comprises a substantially circular shaped portion having a smaller diameter than the first end, wherein the diameter of the first end is at least as large as the diameter of the head of the fastener and the diameter of the second end is smaller than the diameter of the head of the fastener.

19. The chair according to claim 18 wherein the seating surfaces are taken from the group consisting of a seat pan, a backrest pan, an armrest pan, a headrest pan, and a footrest pan.

20. The chair according to claim 18 wherein the chair components are taken from the group consisting of a seat, a backrest, an armrest, a headrest, and a footrest.

21. The chair according to claim 4 wherein the chair components are taken from the group consisting of a seat, a backrest, an armrest, a headrest, and a footrest.

22. The chair according to claim 5 wherein the attachable chair components comprise padding and a decorative covering on a rigid support board.

23. The chair according to claim 6 wherein the attachable chair components comprise padding and a decorative covering on a rigid support board.

24. The chair according to claim 7 wherein the attachable chair components comprise padding and a decorative covering on a rigid support board.

25. The chair as in any of claims 1–4, 18, 19, 20 and 21 in which the attachable chair components comprise padding and a decorative covering on a rigid support board.

* * * * *